United States Patent [19]

Kitagawa et al.

[11] Patent Number: 4,783,620

[45] Date of Patent: Nov. 8, 1988

[54] CONSTANT VOLTAGE CIRCUIT HAVING AN OPERATION-STOP FUNCTION

[75] Inventors: Nobutaka Kitagawa, Kawasaki; Akihiro Sueda, Yokohama; Takesi Suyama, Tokyo, all of Japan

[73] Assignee: Kabushiki Kaisha Toshiba, Kawasaki, Japan

[21] Appl. No.: 71,176

[22] Filed: Jul. 8, 1987

[30] Foreign Application Priority Data

Jul. 11, 1986 [JP] Japan ..... 61-163121

[51] Int. Cl.[4] ..... G05F 3/24

[52] U.S. Cl. ..... 323/313; 331/108 C; 331/116 FE; 331/186

[58] Field of Search ..... 323/313, 314, 315, 316, 323/317, 350, 351, 349; 331/108 C, 108 D, 116 FE, 185, 186

[56] References Cited

U.S. PATENT DOCUMENTS 4,305,011 12/1981 Audaire et al. ..... 323/351
4,387,349 6/1983 Rapp ..... 331/116 FE
4,459,565 7/1984 Leach ..... 331/116 FE
4,492,914 1/1985 Hitomi ..... 323/313
4,565,960 1/1986 Takata et al. ..... 323/351
4,618,837 10/1986 Matsuura ..... 331/186 X

FOREIGN PATENT DOCUMENTS 60-66775 3/1985 Japan .

OTHER PUBLICATIONS

Nikkei Electronics, pp. 215–216, Jun. 21, 1982.

*Primary Examiner*—Peter S. Wong
*Attorney, Agent, or Firm*—Finnegan, Henderson, Farabow, Garrett & Dunner

[57] ABSTRACT

A constant voltage circuit comprises a capacitor connected between one end of a MOS transistor controlled by an operation-stop control signal and an output terminal of an inverter for inverting the operation-stop control signal. When, in the circuit having this arrangement, the transistor for operation-stop control is turned off and the hold mode is ended, the potential at one end of the transistor is quickly lowered to the ground potential. The result is to quicken the start of operation of the constant voltage circuit and hence the rise of the constant voltage output.

10 Claims, 6 Drawing Sheets

CONSTANT VOLTAGE CIRCUIT HAVING AN OPERATION-STOP FUNCTION

BACKGROUND OF THE INVENTION

This invention relates to a constant voltage circuit contained in a CMOS (complementary metal oxide semiconductor) integrated circuit, for generating a constant voltage to be used as a bias voltage for an oscillator, for example, and, more particularly, to a constant voltage circuit having an operation-stop function of the type in which a constant voltage output is controlled by an operation-stop control signal.

In the CMOS integrated circuit used in microcomputers, electronic wrist watches, etc., an oscillating circuit with a crystal resonator or a ceramic resonator is used to obtain an exact operating frequency. The oscillator using source common type inverter 1 as shown in FIG. 1 is a typical example of such an oscillator, and is disclosed in "Nikkei Electronics" 1982, June, Vol, 21, pp 215 to 216. In this oscillator, bias circuit 2 is made up of P-channel MOS transistors P4 and P5, N-channel MOS transistors N4 and N5, and current-restricting resistor R. Bias voltage $V_{BIAS}$ has a first-order dependency on power voltage $V_{DD}$. This bias voltage is applied from bias circuit 2 to the gate of P-channel MOS transistor P1 of common source type inverter 1. With the application of this bias voltage, the current flowing into inverter 1 is made constant, and transistor P1 is used as a constant current source, which is not dependent on power voltage $V_{DD}$. With such an arrangement, the oscillation-start voltage depends only on the threshold voltage $V_{THN}$ of N-channel MOS transistor N1. Therefore, if the amplification factor of inverter 1 is set at an appropriate value, the FIG. 1 circuit operates as an oscillator which is operable at low voltage, since the constant current circuit can operate at low current; hence, low power dissipation can be realized.

If such an oscillator, having low power dissipation and low current, and packed in an IC, is incorporated in a microcomputer, the power consumption of the oscillator is wasted when the microcomputer is in the power-down mode. The applicant of this patent application has proposed, in Japanese application No. 60-66775, an oscillator with an oscillation-stop function in which the oscillation is stopped by an oscillation-stop signal, as is shown in FIG. 2. Referring to FIG. 2, N-channel transistor N2 and P-channel transistor P2, which are switch-controlled by oscillation-stop control signal $\overline{HOSC}$, are also incorporated in source common type inverter 1. Bias circuit 2 is also provided with P-channel transistor P3 which is switch-controlled by the control signal $\overline{HOSC}$ and N-channel transistor N3 which is switch-controlled by the output signal HOSC of CMOS inverter I1, which is used for inverting this $\overline{HOSC}$ signal.

P-channel transistor P3 and N-channel transistor N3 in bias circuit 2 are both in an off state when in a normal operating mode, i.e., when the $\overline{HOSC}$ signal is at logical level "1". Also, when in this mode, a predetermined bias voltage appears at output node Na. When in a hold mode (operation is stopped), i.e., when the $\overline{HOSC}$ signal is at logical level "0", P-channel transistor P3 and N-channel transistor N3 are both in an on state, and power voltage $V_{DD}$ appears at output node Na. In this mode, the P-channel transistor P1 of source common type inverter 1 is also in an off state. As a result, no current flows in inverter 1, thereby saving power.

In bias circuit 2, when the operation mode reverts from the hold mode to the normal mode, the bias voltage rises slowly, with the result that the oscillation-start time may be long, as is shown in FIG. 3. As can be seen in this figure, when in the hold mode, the output node Na is at $V_{DD}$ level. The instant the hold mode is ended, P-channel transistors P3, P4, and P5, and N-channel transistors N3, N4, and N5 are in the off state. Therefore, the output node Na is electrically in a floating state, and dynamically holds the $V_{DD}$ level. Depending on the amount of leakage current between the output node Na and the IC board, the potential at the output node Na gradually drops from the $V_{DD}$ level. In the course of the drop in potential, P-channel transistors P4 and P5 and N-channel transistors N4 and N5 are turned on. Thereafter, a fixed bias voltage appears at node Na, and the source common type inverter 1 initiates oscillation when the bias voltage output is $V_{DD}-(|V_{THP}|+\alpha)$. In this mathematical expression, $V_{THP}$ is the threshold voltage of the P-channel transistor P1 of the inverter 1, and $\alpha$ is an additional gate bias voltage for making the constant current flow in P-channel transistor P1.

SUMMARY OF THE INVENTION

The object of this invention is to solve the problem of the slowness in the rising of the constant voltage output when the hold mode is ended, and, to this end, to provide a constant voltage circuit having an operation-stop function which enables the constant voltage output to rise quickly.

A constant voltage circuit having an operation-stop function according to the present invention comprises a capacitor which is connected between one end of a MOS transistor controlled by an operation-stop control signal and an output terminal of an inverter for inverting the operation-stop control signal, and/or a capacitor which is connected between one end of a MOS transistor controlled by the inverted signal of the operation-stop control signal and the output terminal of an inverter for inverting the inverted signal of the operation-stop control signal.

When, in the circuit having this arrangement, the transistor for operation-stop control is turned off and the hold mode is ended, the potential at one end of the transistor is quickly lowered to the ground potential or else is raised to the power potential. The result of this is to quicken the start of operation of the constant voltage circuit, and hence the rise of the constant voltage output.

DETAILED DESCRIPTION OF THE PREFERRED EMBODIMENTS

Some specific embodiments of this invention will now be described, with reference to the accompanying drawings.

Figure 1:
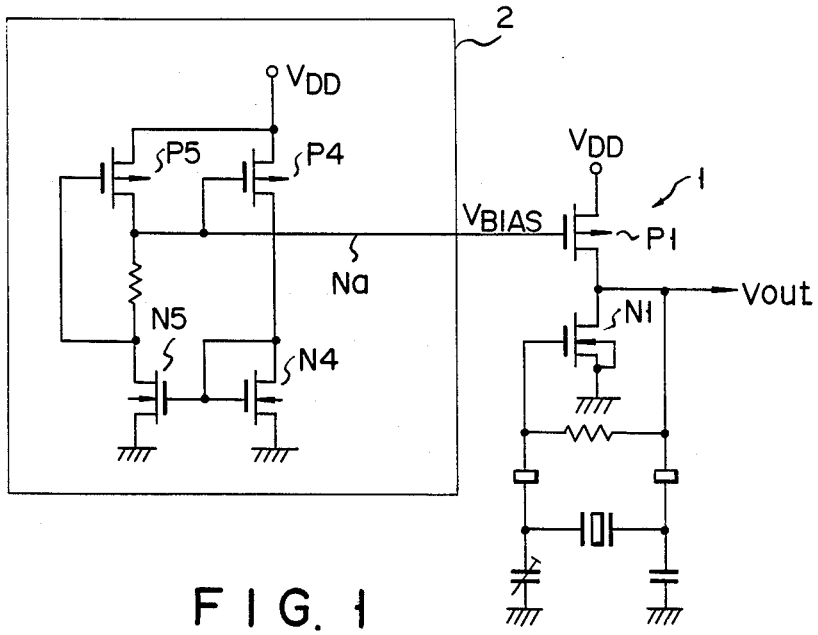
FIG. 1 (PRIOR ART)
FIG. 1 is a circuit diagram of a conventional oscillation circuit.
Figure 2:
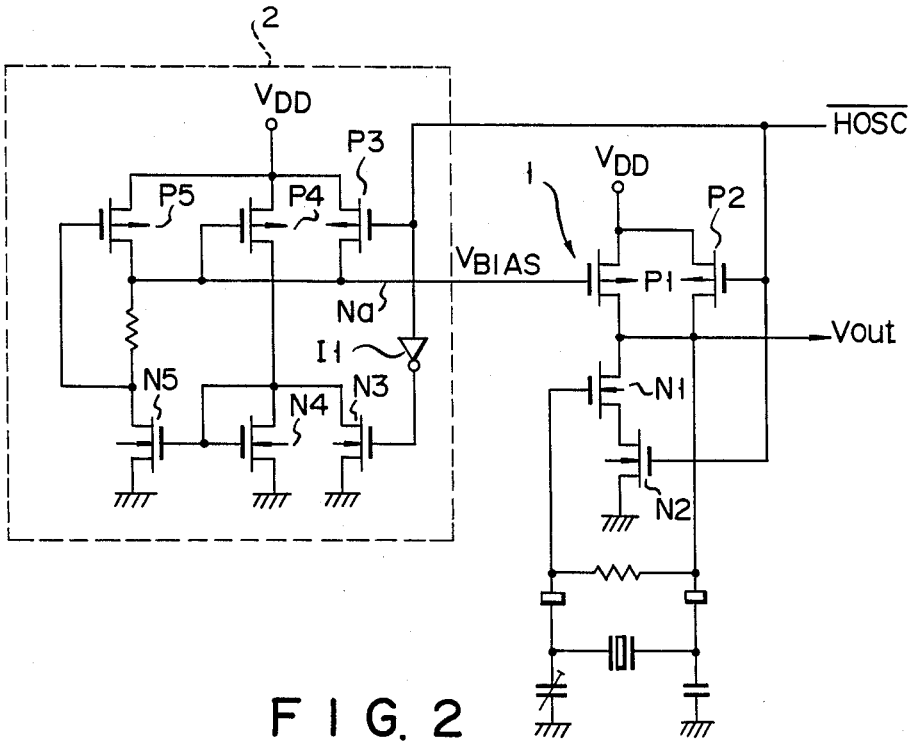
FIG. 2 is a circuit diagram of an oscillation circuit with an oscillation-stop function, which was filed by the applicant of the present patent application.
Figure 3:
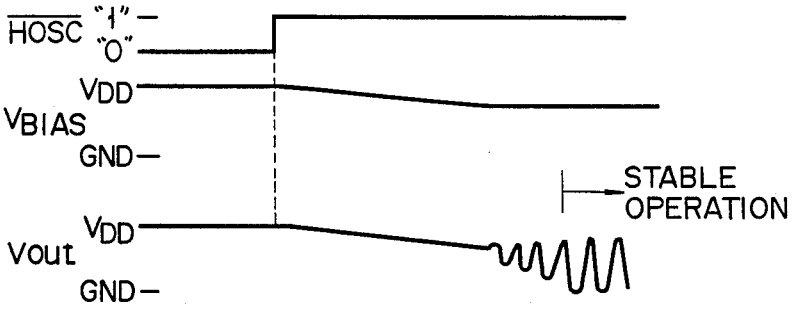
FIG. 3 shows a set of waveforms for explaining the operation of the FIG. 1 circuit.
Figure 4:
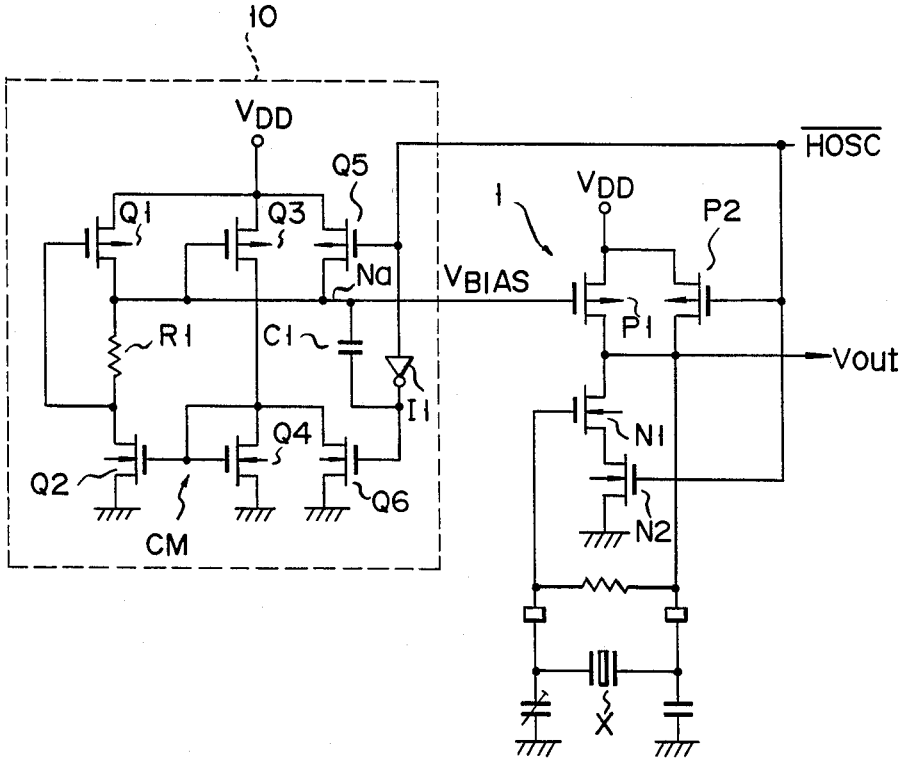
FIG. 4 is a circuit diagram of a constant voltage circuit with an operation-stop function according to a first embodiment of this invention.

The circuit having the configuration as shown in FIG. 4 contains an oscillation circuit having an oscillation-stop function, which is incorporated in an integrated circuit, and a resonator X externally connected to the IC oscillation circuit. The oscillation circuit includes source common type inverter 1 having an operation-stop function, and a constant voltage circuit 10 also having an operation-stop function. In bias circuit 10, P-channel transistor Q1, resistive element R1, and N-channel transistor Q2 are connected in series between a $V_{DD}$ power node at positive potential and ground. P-channel transistor Q2 and N-channel transistor Q4 are also connected in series between the $V_{DD}$ power node and ground. Bias circuit 10 also includes P-channel transistor Q5, whose drain-source path is connected between the $V_{DD}$ power node and the output node (the interconnection point between P-channel transistor Q1 and resistive element R1). The gate of transistor Q5 is supplied with hold signal $\overline{HOSC}$. CMOS inverter I1 inverts the logical level of hold signal $\overline{HOSC}$ and the output signal HOSC of inverter I1 is input to the gate of N-channel transistor Q6. The source-drain path of transistor Q6 is connected between the drain of P-channel transistor Q3 and ground. The drain of N-channel transistor Q2 (the interconnection point of N-channel transistor Q2 and resistive element R1) is connected, in a feedback manner, to the gate of P-channel transistor Q1. The drain and gate of N-channel transistor Q4 are interconnected. The gates of transistors Q4 and Q2 are interconnected to form an N-channel current mirror circuit CM. The gate of P-channel transistor Q3 is connected to the output node Na. In this embodiment, the output node Na in bias circuit 10 and the output terminal of CMOS inverter I1 have a speed-up capacitor arranged therebetween. It should be noted that all of the above transistors are MOS FETs (metal oxide semiconductor field-effect transistors).

Figure 5:
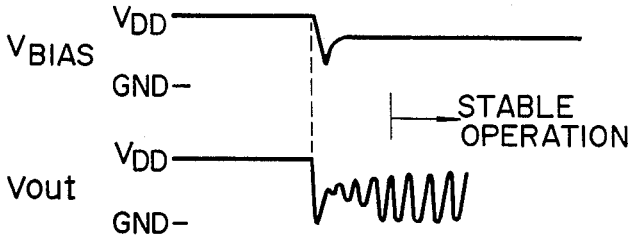
FIG. 5 shows waveforms illustrating the operation of the constant voltage circuit of FIG. 4.

The operation of the oscillation circuit will now be described, with reference to FIG. 5. When hold signal $\overline{HOSC}$ is logical "1" (the circuit in question is in the normal operation mode), the transistor P2 of source common type inverter 1 is in an off-state, while the transistor N2 is in an on-state. The transistors Q5 and Q6 of bias circuit 10 are both in the off-state. At this time, in bias circuit 10, current is flowing through transistors Q1 to Q4, and the feedback operation is performed so that the bias voltage at output node Na is kept constant. For example, when the output voltage is high, the gate bias voltage of P-channel transistor Q3 is low and the source current is small. Therefore, the current in current mirror circuit CM is also small, as is also the current flowing through P-channel transistor Q1. In this way, the output voltage is kept constant. The constant voltage output is applied, as the bias voltage, to source common inverter 1, causing oscillation to occur.

On the other hand, when the hold signal $\overline{HOSC}$ is logical "0" (hold mode), transistor P2 of source common type inverter 1 is turned on, and transistor N2 is turned off. Under this condition, no current flows in source common type inverter 1, the voltage at $V_{DD}$ level appears as the output voltage Vout of the oscillation circuit, and oscillation stops. Transistors Q5 and Q6 in bias circuit 10 are both placed in the on-state, with the result that output node Na becomes $V_{DD}$ level. Transistors Q1 to Q4, however, are placed in the off-state. Thus, all of the DC paths are in the off-state, no current flows in bias circuit 10, and the output terminal of CMOS inverter I1 becomes $V_{DD}$ level.

When hold signal $\overline{HOSC}$ is logical "1" and the hold mode is ended, transistors Q5 and Q6 are both in the off-state, and the output terminal of CMOS inverter I1 is lowered to the ground potential (logical "0") upon lapse of the delay time of inverter I1. The electrical charges at output node Na are abruptly discharged through capacitor C1, and the potential at output node Na is instantaneously and forcibly lowered to the ground potential. In turn, P-channel transistor Q3 is instantaneously turned on, as is P-channel transistor Q1, the latter via current mirror circuit CM. The potential at the output node Na is quickly charged to a predetermined constant voltage. Consequently, source common type inverter 1 immediately begins operation. Thus, the time period from the ending of the hold mode to the start of oscillation is very short.

Figure 6:
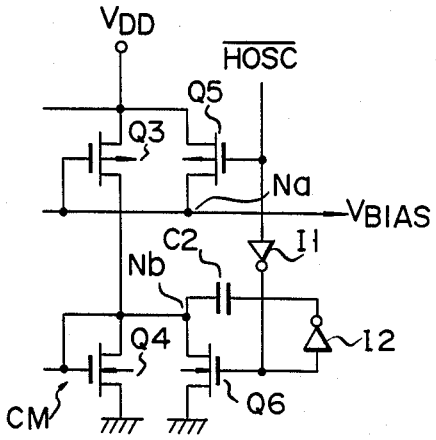
FIGS. 6 to 12 are circuit diagrams of the bias circuit used in the FIG. 4 circuit.

The constant voltage circuit according to this invention is not limited to the above-mentioned embodiment, but may be changed and modified variously within the scope of the invention. The location of the speed-up capacitor may be selected as judged appropriate; for example, as in FIGS. 6 and 7. In other words, its location can be selected with a degree of flexibility. A part of the constant voltage circuit is shown in FIG. 6. As shown, the gate of N-channel transistor Q6 is connected via CMOS inverter I2 to one end of capacitor C2. The other end of capacitor C2 is connected to one end (node Nb) of N-channel transistor Q6, for operation-stop control. In this circuit, when the hold mode is ended, P-channel transistor Q5 and N-channel transistor Q6 are both turned off, and, as a result, the potential at the output terminal rises to level "1" ($V_{DD}$ level) after the gate delay time of the CMOS inverter I2. As a result, the potential at node Nb is quickly raised to the $V_{DD}$ level, the current mirror circuit CM quickly begins operation, and the bias voltage rises at high speed. The above-mentioned embodiment incorporates only one stage of CMOS inverter I2; however, three inverter stages, or any greater odd number of inverter stages may be provided; if necessary. Provision of one stage of an inverter generally results in the least gate delay time.

Figure 7:
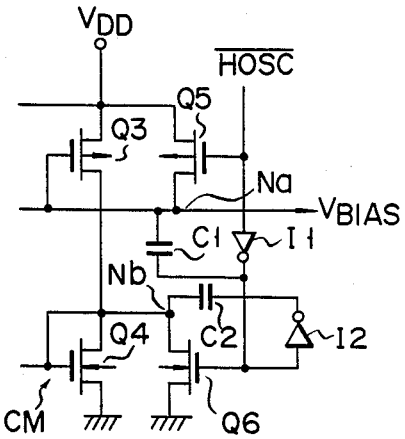

The constant voltage circuit partially illustrated in FIG. 7 contains capacitor C1 connected in a similar fashion as in the FIG. 4 circuit, and CMOS inverter I2 and capacitor C2, which are connected in a similar fashion as in the FIG. 6 circuit. Therefore, when the hold mode is ended, the potential at one end (output node Na) of transistor Q5 for operation-stop control is quickly lowered to the ground potential, while the potential at one end (node Nb) of N-channel transistor Q6 is quickly raised to the $V_{DD}$ level. Consequently, the bias voltage output rises more quickly.

Those portions of the constant voltage circuit which are not shown in FIGS. 6 and 7 are of the same structure as those portions of the constant voltage circuit of the oscillation circuit shown in FIG. 4.

Figure 8:
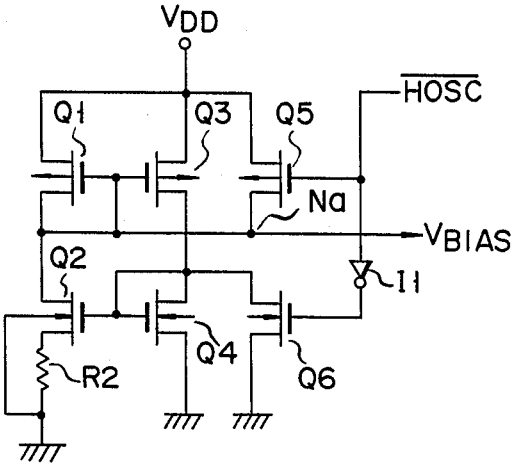
Figure 9:
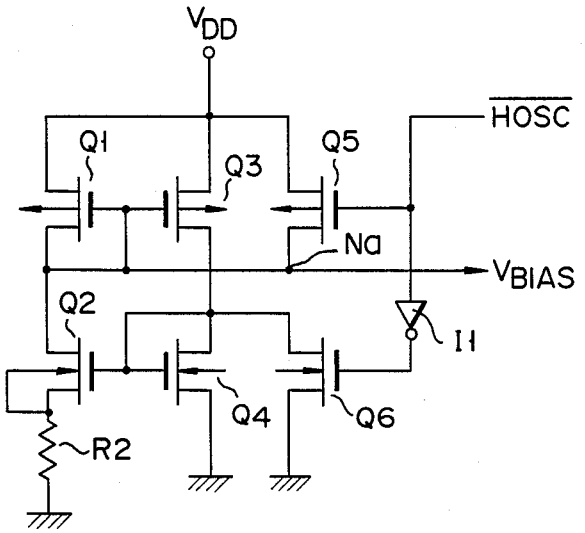
Figure 10:
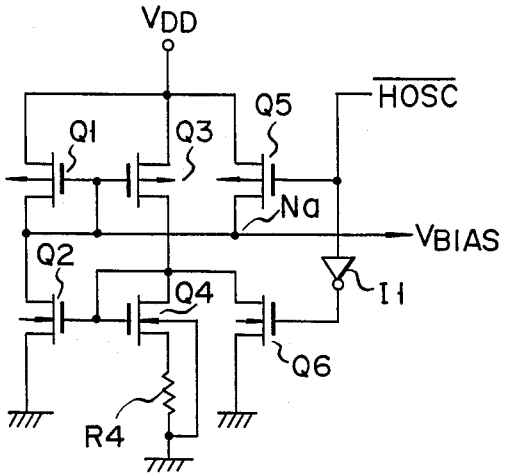
Figure 11:
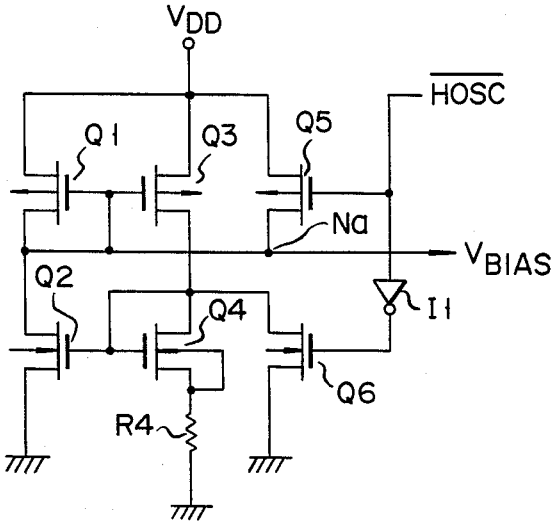

FIGS. 8 to 12 show modifications of the bias circuit of this invention. In these figures, the speed-up capacitor is not illustrated. The circuit of FIG. 8 is a modification of the FIG. 4 circuit, wherein resistive element R1 is omitted and resistive element R2 is connected between the source of N-channel transistor Q2 and the ground terminal. The substrate (P-well region of the CMOS structure) of N-channel transistor Q2 is connected to the ground terminal. The FIG. 9 circuit is, in turn, a modification of the FIG. 8 circuit. In the circuit of FIG. 9, the source of N-channel transistor Q2 is connected to the substrate (the P-well region of the CMOS structure), in order to keep the back-gate bias of the transistor constant. The FIG. 10 circuit is also a modification of the FIG. 4 circuit, wherein resistive element R1 is omitted and resistive element R4 is connected between the source of transistor Q4 and the ground terminal. The substrate (the P-well region of the CMOS structure) of N-channel transistor Q4 is connected to the ground terminal. The FIG. 11 circuit is a modification of the FIG. 10 circuit, wherein the source of transistor Q4 is connected to the substrate.

Figure 12:
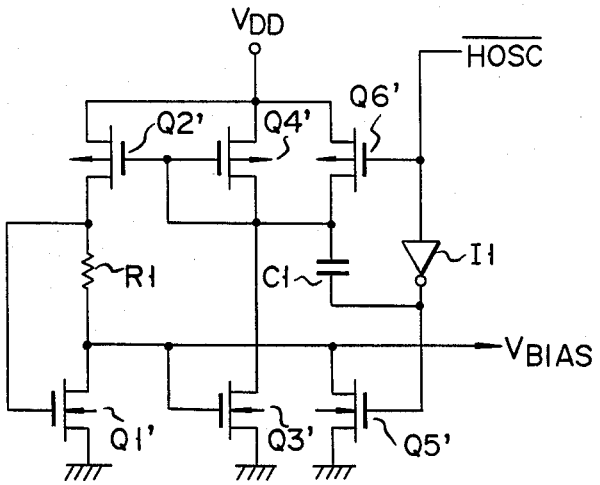

In the FIG. 12 circuit is a further modification of the FIG. 4 circuit, in which the P-channel transistors and the N-channel transistors are interchanged, and the $V_{DD}$ power node is interchanged with the ground terminal. Further, capacitor C1 is placed between the output terminal of CMOS inverter I1 and one end (drain) of P-channel transistor Q6' for operation-stop control.

Bias circuit 10 shown in FIG. 12 can also be modified in various ways, as is shown in FIGS. 6 to 11. In FIG. 12, the transistors corresponding to Q1 to Q6 in FIG. 4 are designated by reference numerals Q1' to Q6'.

Figure 13:
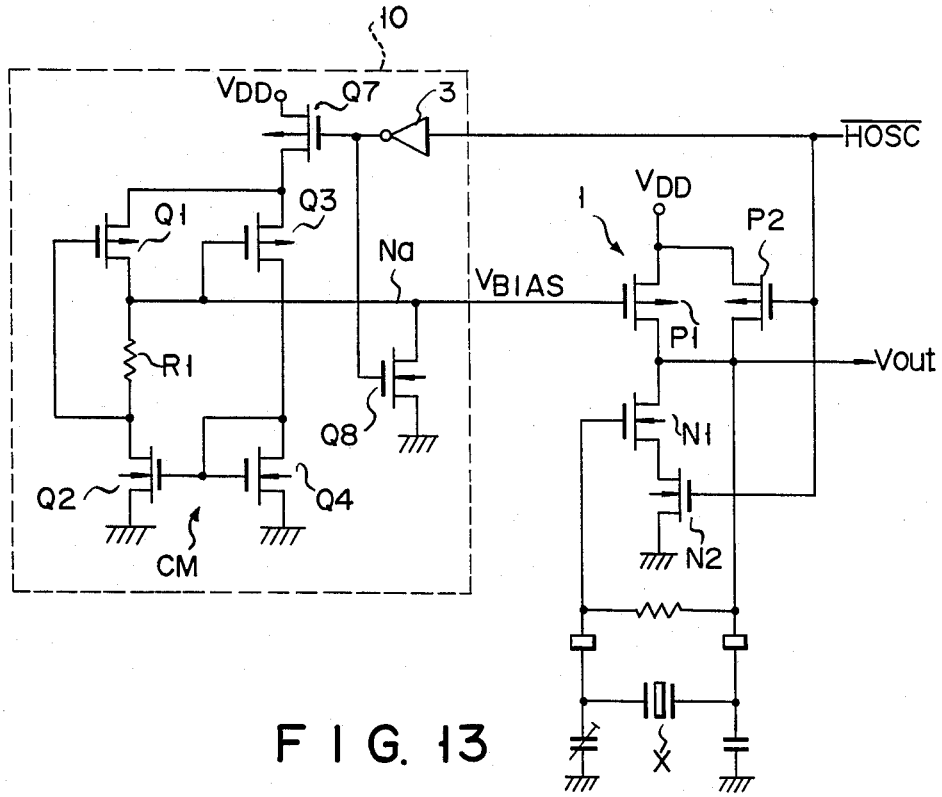
FIG. 13 is a circuit diagram of a constant voltage circuit having an operation-stop function according to another embodiment of the invention.

FIG. 13 shows another embodiment of this invention.

In the description of this embodiment, the same reference numerals are used for describing corresponding portions in FIG. 4.

In this embodiment, inverter 3, P-channel MOS transistor Q7, and N-channel MOS transistor Q8 are incorporated, P-channel MOS transistor Q5, N-channel MOS transistor Q6, capacitor C1, and inverter I1 being omitted.

P-channel MOS transistor Q7 is inserted between power voltage $V_{DD}$ and P-channel MOS transistor Q3. N-channel MOS transistor Q8 is inserted between output node Na and ground. Inverter 3 inverts the logical level of hold signal $\overline{HOSC}$. The output signal HOSC of inverter 3 is input to the gates of transistors Q7 and Q8.

The operation of this embodiment will now be described in detail.

When hold signal $\overline{HOSC}$ is logical "1" (in the normal operation mode), the transistor P2 in common source type inverter is in the off-state, and transistor N2 is in the on-state. Further, transistor Q7 in bias circuit 10 is in the on-state and transistor Q8 is in the off-state. Under this condition, in bias circuit 10, current flows through transistors Q1 to Q4, and feedback control is executed so that the bias voltage at output node Na is kept constant. For example, when the output voltage becomes high, the gate bias of P-channel transistor Q2 becomes small, as does also the source current. Consequently, the current in current mirror circuit CM also becomes small, as does also the current of P-channel transistor Q1. In this way, the output voltage is kept constant. Then, the constant voltage is applied as the bias voltage to source common type inverter 1, so that oscillation takes place.

On the other hand, when hold signal $\overline{HOSC}$ is logical "0" (in the hold mode), the transistor P2 in inverter 1 is turned on, while transistor N2 is turned off. Therefore, no current flows into source-common type inverter 1, the voltage at $V_{DD}$ level appears as the output voltage Vout of the oscillation circuit, and oscillation stops. Transistor Q7 in the bias circuit 10 is placed in the off-state, and transistor Q8 is placed in the on-state. Output node Na is at ground level, transistors Q1 to Q4 are all in the off-state, and hence all of the DC current paths are in the off-state. Therefore, no current flows in bias circuit 10, and the output terminal Na of CMOS inverter I1 becomes at ground level.

When hold signal $\overline{HOSC}$ is logical "1" and the hold mode is ended, transistor Q7 is turned on and transistor Q8 is turned off, and the output terminal of inverter I1 becomes at ground level (logical "0") upon lapse of the delay time of inverter I1.

When hold signal $\overline{HOSC}$ is logical "0" (in the hold mode), the output mode Na is at ground level. When, therefore, hold signal $\overline{HOSC}$ is at logical level "1" and the hold mode is ended, the potential at output node Na rises from the reference level, which is the ground level, in this case. In other words, the potential at output node Na rises from the ground level, as the reference level, by the potential as determined by the stray capacitance between output node Na and power potential $V_{DD}$, and between output node Na and ground potential. Accordingly, the potential at the output node Na is more closer to the ground level than in the case where the reference level is set above the ground level. Therefore, the decrease in the amount of current flowing through the transistor P1 of inverter 1 is minimized. This implies that stable operation has been secured.

In the constant voltage circuit with the operation-stop function of the present invention, the rise in the constant voltage output is quickened, as compared to the prior art device. Therefore, if the above constant voltage circuit is utilized in the bias circuit of an oscillator having the oscillation-stop function, comprising a source common type inverter with low power dissipation and low operating voltage characteristics, the oscillation-start time can be reduced.

What is claimed is:

1. A constant voltage circuit having an operation-stop function, comprising:

a first capacitor element connected between one end of a first operation-stop control MOS transistor controlled by an operation-stop control signal and an output terminal of a first inverter for inverting said operation-stop control signal to produce an inverted operation-stop control signal; and a second capacitor element connected between one end of a second operation-stop control MOS transistor controlled by the inverted operation-stop control signal and an output terminal of a second inverter for inverting said inverted operation-stop control signal.

2. A constant voltage circuit having an operation-stop function, comprising:

a first capacitor element connected between one end of a first operation-stop control MOS transistor controlled by an operation-stop control signal and an output terminal of a first inverter for inverting said operation-stop control signal to produce an inverted operation-stop control signal; and a second capacitor element connected between one end of a second operation-stop control MOS transistor controlled by the inverted operation-stop control signal and an output terminal of a second inverter for inverting said inverted operation-stop control signal, wherein when said first and second operation-stop control MOS transistors are turned off, a potential at said one end of said first operation-stop MOS transistor is lowered to a first power potential, and a potential at said one end of said second operation-stop control MOS transistor is raised to a second power potential.

3. A constant voltage circuit according to claim 2, wherein said second operation stop control MOS transistor is turned off, a potential at said one end of said second operation stop control MOS transistor is raised.

4. A constant voltage circuit having an operation-stop function, comprising:

first and second MOS transistors, of first and second conductivity types, respectively, each having a gate and source, drain, and source-drain path, said first and second MOS transistors being connected in series between said first and second power source terminals;

third and fourth MOS transistors, of first and second conductivity types, respectively, each having a gate, source, drain and source-drain path, said third and fourth MOS transistors being connected in series between said first and second power source terminals;

a first connection line, for connecting the gate of said first MOS transistor and the drain of said second MOS transistor;

an output mode at the connection between the gate of said first MOS transistor and the drain of said second MOS transistor;

a second connection line for connecting the gate of said fourth transistor and the drain thereof;

a fifth MOS transistor, of the first conductivity type, having a source, a drain, and a source-drain path connected between said first power source terminal and the output node, and having a gate which receives an operation-stop control signal;

an inverter for inverting the operation-stop control signal to produce an inverted operation-stop control signal;

a sixth MOS transistor, of the second conductivity type having a source, a drain, and a drain-source path connected between the drain of said third MOS transistor and said second power source terminal, said sixth transistor receiving the inverted operation-stop control signal; and a capacitor connected between an output terminal of the inverter and the drain of said fifth MOS transistor.

5. A constant voltage circuit according to claim 4, in which said constant voltage circuit operates as a bias circuit for an oscillation circuit having an oscillation-stop function, which uses a source common type inverter.

6. A constant voltage circuit having an operation-stop function, comprising:

an output terminal at a given potential;

a first MOS transistor, of a first channel type, connected to a first power potential, and controlled by an inverted operation-stop control signal;

a second MOS transistor, of a second channel type, connected between the output terminal of said circuit and a second power potential, and controlled by the inverted operation-stop control signal, wherein when said operation-stop control signal is at a second logical level, said second MOS transistor is turned on, and the potential of said output terminal is set at said second power potential, and wherein when said operation-stop control signal is set at a first logical level, said first MOS transistor is turned on, and the potential of said output terminal rises to a predetermined potential.

7. A constant voltage circuit having an operation-stop function, comprising:

first and second MOS transistors, of first and second conductivity types, respectively, each having a gate and source, drain, and source-drain path, said first and second MOS transistors being connected in series between said first and second power source terminals;

third and fourth MOS transistors, of first and second conductivity types, respectively, each having a gate source, drain and source-drain path, said third and fourth MOS transistors being connected in series between said first and second power source terminals;

a first connection line, for connecting the gate of said first MOS transistor and the drain of said second MOS transistor;

an output node at the connection between the gate of said first MOS transistor and the drain of said second MOS transistor;

a second connection line for connecting the gate of said fourth transistor and the drain thereof;

a fifth MOS transistor, of the first conductivity type, having a source, a drain, and a source-drain path connected between said first power source terminal and the output node, and having a gate which receives an operation-stop control signal;

an inverter for inverting the operation-stop control signal to produce an inverted operation-stop control signal at an output terminal;

a sixth MOS transistor, of the second conductivity type having a source, a drain, and a drain-source path connected between the drain of said third MOS transistor and said second power source terminal, said sixth transistor receiving the inverted operation-stop control signal from said output terminal;

a capacitor connected between the output terminal of the inverter for inverting said operation-stop control signal and the drain of said fifth MOS transistor; and a capacitor connected between an output terminal of the inverter and the drain of said sixth MOS transistor.

8. A constant voltage circuit having an operation-stop function, comprising a capacitor element connected between one end of a MOS transistor controlled by an inverted operation-stop control signal, and an output terminal of an inverter for inverting an operation-stop control signal to produce said inverted operation-stop control signal.

9. A constant voltage circuit having an operation-stop function, comprising a capacitor element connected between one end of a MOS transistor controlled by an operation-stop control signal and an output terminal of an inverter for inverting said operation-stop control signal to produce an inverted operation-stop control signal at the output terminal.

10. A constant voltage circuit according to claim 8, wherein when said MOS transistor is turned off, a potential at said one end of said MOS transistor is lowered to a predetermined power potential.

* * * * *